United States Patent [19]

Wilzig et al.

[11] 4,209,876

[45] Jul. 1, 1980

[54] DOOR STOP

[76] Inventors: Herbert Wilzig, 606 N. 55th St., Montebello, Calif. 90640; Charles J. Schuessler, 1340 E. Ruddock, Covina, Calif. 91722

[21] Appl. No.: 27,763

[22] Filed: Apr. 6, 1979

[51] Int. Cl.[2] ..... E05F 5/02

[52] U.S. Cl. ..... 16/82; 292/DIG. 15

[58] Field of Search ..... 16/82, 86 R, 86 A, 86 B; D8/402; 292/DIG. 15, DIG. 19, 341.12, 340

[56] References Cited

U.S. PATENT DOCUMENTS

| | | | |
|---|---|---|---|
| 1,340,621 | 5/1920 | Miers | 16/86 A |
| 2,311,278 | 2/1943 | Johnson | 16/86 A |
| 3,010,142 | 11/1961 | Ahlquist | 16/86 A |
| 3,159,416 | 12/1964 | Schlage | 292/340 |

FOREIGN PATENT DOCUMENTS

| | | | |
|---|---|---|---|
| 480809 | 3/1938 | United Kingdom | 292/340 |

*Primary Examiner*—Andrew V. Kundrat

*Attorney, Agent, or Firm*—Poms, Smith, Lande & Rose

[57] ABSTRACT

A floor mountable door stop having a quarter-spherical backstop portion with a substantially vertical backstop face, an integral tongue mounting portion extending away from the bottom of the backstop face, and an integral anchor member extending downwardly from the bottom end of the backstop portion, wherein the door stop is manufactured by stamping thin sheet metal. In a preferred embodiment, the anchor member is semi-circular so as to mate with a semi-circular or C-shaped slot in the floor.

4 Claims, 4 Drawing Figures

DOOR STOP

BACKGROUND OF THE INVENTION

1. Field of the Invention

This invention relates to door stops, and particularly to metal, floor-mounted, backstop type door stops. Specifically, these door stops comprise a quarter-spherical backstop portion having a substantially vertical backstop face, an integral flat tongue mounting portion extending away from the bottom of the backstop face and having an aperture for use in mounting the door stop to the floor, and an integral anchor member extending downwardly from the bottom end of the quarter-spherical backstop portion which is adapted to fit into a mounting hole in the floor.

2. Description of the Prior Art.

The prior art door stops to which this invention relates have been thick, heavy, cast-metal pieces which, because having been manufactured by casting, have embodied many inherent disadvantages and undesirable features.

Because these door stops have been manufactured by casting methods in the past, they have by necessity been quite thick and heavy, being more than one-sixteenth of an inch in thickness. This minimum thickness required by the casting process has also required that the tongue mounting member be this minimum thickness above the floor. This minimum thickness of the tongue member has required that the bottom of the door be at least this distance above the floor so to be able to pass over the tongue member and engage the backstop face. However, many times it is necessary or desirable to provide a door whose bottom edge rides only a short distance over the floor. Because the door stop of this invention can be manufactured from relatively thin sheet metal, the tongue member can be made to rest a very minimal distance off of the floor.

Further, the prior art door stops related to this invention have in the past used a solid round integral anchor member. Because this anchor member was round, it did not provide any restriction against rotative movement about the anchor should the screw or bolt at the other end come loose. Another feature of this invention provides that the anchor be semi-circular rather than fully round. Therefore, when inserted into a mating semi-circular mounting hole in the floor, the anchor could by itself prevent rotation about itself should the fastening means at the other end fail.

SUMMARY OF THE INVENTION

It is, therefore, a primary object of this invention to provide a novel door stop which is significantly thinner and lighter than door stops of this type previously known or used.

Another object of this invention is to provide a thinner and lighter door stop as above wherein the tongue portion of the door stop can be made significantly thinner than in prior door stops of this type so that the distance between the bottom of the door and the floor can be significantly reduced.

A still further object of the invention is to provide a door stop which is thinner than any door stops of this type previously known or used which will allow it to be manufactured from sheet metal by quicker and less expensive stamping methods.

Yet another object of this invention is to provide a door stop having an anchor member which will prevent rotation of the door stop about the anchor member.

These and other objects of this invention will be apparent to those skilled in the art by reference to the remaining portion of the specification and the drawings.

Briefly, these and other objects of the invention are provided for by a floor-mounted, backstop type door stop comprising a quarter-spherical backstop portion having a substantially vertical backstop face, an integral flat tongue portion extending away from the bottom of the backstop face and having an aperture for use in mounting the door stop to the floor, and an integral anchor member extending downwardly from the bottom end of the quarter-spherical backstop portion, for insertion into a mounting hole in the floor, and which is made of material which will allow the door stop to be made by a stamping process.

It is preferred that the door stop be made of sheet metal no thicker than about 0.060 inches, and preferably between about 0.040 and 0.060 inches, e.g. 0.050 inches.

It is also preferred that the integral anchor member have a semi-circular shape so as to mate with a semi-circular hole in the floor thereby preventing rotation about this anchor point.

The advantages of manufacturing these backstop type door stops of material no thicker than about 0.062 inches is that it will allow the door stops to be manufactured by stamping methods which are quicker and more economical than the traditional casting methods used to manufacture door stops in the past.

DETAILED DESCRIPTION OF THE INVENTION

Figure 1:
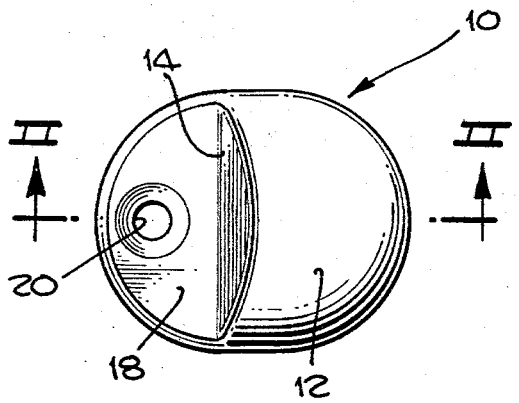
FIG. 1 is a top view of the door stop of this invention.
Figure 2:
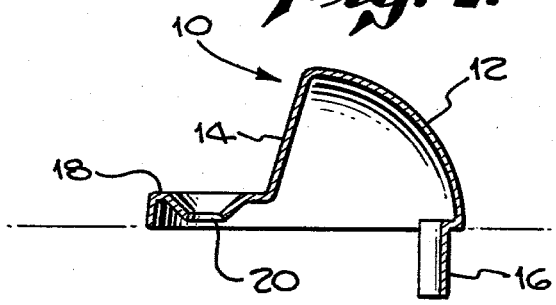
FIG. 2 is a cross-sectional view of the door stop in FIG. 1 along the plane II—II.
Figure 3:
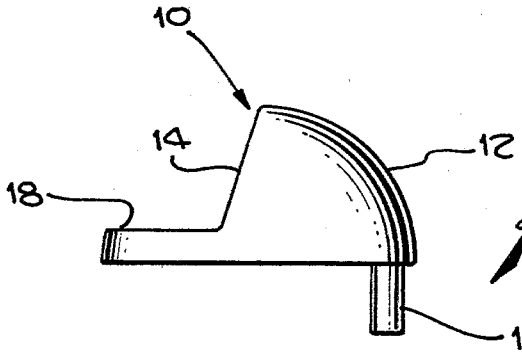
FIG. 3 is a side view of the door stop shown in FIG. 1.
Figure 4:
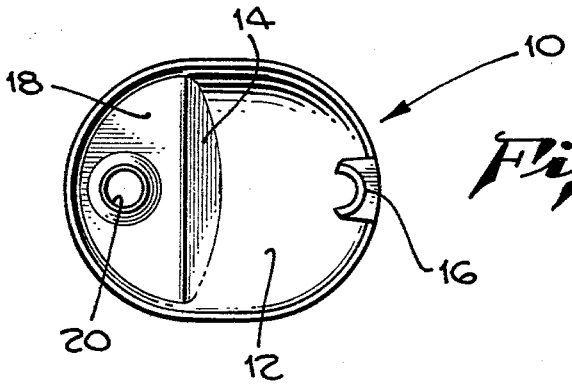
FIG. 4 is the bottom view of the door stop shown in FIG. 1.

Referring now to FIGS. 1-4, there is shown the door stop of this invention. The door stop of this invention is a floor-mounted, backstop type door stop. Door stops of this type are mounted on the floor at a point where it will meet the radially outer end of the bottom of the door and prevent it from swinging into a wall or other barrier.

Door stop 10 comprises a substantially quarter-spherical backstop portion 12 having a substantially vertical backstop face 14. The purpose and function of the backstop face 14 is to provide a stopping surface for the door moving toward it. Therefore, while it is preferred that the backstop face be vertical, it may take other substantially vertical positions adequate to perform this function. As shown in the drawing, backstop face 14 is substantially vertical, it being actually about 20° off the vertical plane.

In commercial door stops of this type, it is desirable to attach a piece of semi-hard rubber to the backstop face 14 to prevent noise and damage to the door surface. This is normally done by snapping in a properly formed piece of rubber into a properly sized aperture made in the backstop face 14.

Because the backstop face receives the force of the door hitting it, support must be provided to hold the backstop face in position after repeated door stoppings. This support is provided by the substantially quarter-spherical backstop portion 12. While it is not critical that the backstop portion 12 be substantially quarter-spherical, this shape provides the necessary rigidity and support for the backstop face 14. Other shapes or mechanical configurations could be used.

At the bottom end of backstop portion 12 is anchor member 16. The anchor member is designed to be inserted into a receiving hole located in the floor. The anchor member is integral with the backstop portion and extends downwardly. In prior art door stops of this type, this anchor member has been a solid, cast, cylindrical member. In a preferred embodiment of this invention, the anchor member is preferably semi-circular as shown in the drawing as member 16.

The use of a semi-circular anchor member by inserting it into a semi-circular hole or C-shaped slot will prevent the rotation of the door stop about the anchor member. This is in marked distinction to the use of a cylindrical anchor member which by itself does not prevent the door stop from rotating about the anchor. This is important in the event that the fastening means on the other end of the door stop comes loose or is not used; the use of a semi-circular anchor member will by itself fixedly locate the door stop on the floor.

Extending away from the bottom of the backstop face 14 is an integral flat tongue, mounting portion 18. The tongue portion serves the purpose of providing a second location for fastening the door stop to the floor. This is accomplished by providing an aperture in the tongue portion, as is shown in the drawing as aperture 20. A screw or bolt, or other fastening device can be inserted through aperture 20 to mount the door stop to the floor. Therefore, in the preferred manner of installation, the door stop will be mounted to the floor by means of the anchor member and the aperture in the tongue portion.

An important feature of this invention is that constructing the door stop of material no thicker than about 0.060 inches, such as sheet metal, allows this tongue portion to be formed so as to be no thicker than the thickness of the material itself. This is accomplished by stamping the tongue portion so as to be flat and not raised off the surface of the floor. This is advantageous because when the door stop is mounted on the floor, the bottom of the door must be high enough off the floor in order to pass over the tongue portion and strike the backstop face. Because it is often desirable to minimize the clearance between the bottom of the door and the floor, it is important to reduce the overall thickness of the tongue portion. However, in the prior door stops which have been manufactured by casting, it was impossible to reduce the thickness of the tongue portion below that necessary to yield a sufficiently strong casting, more than 1/16 inch.

METHOD OF MANUFACTURE

Because the door stop of this invention is intended to be made with sheet metal no thicker than about 0.060 inches, it is preferable to manufacture the door stop by means of blanking and stamping. The door stop can preferably be made from sheet metal (e.g. aluminum, brass, bronze, or stainless steel) in thicknesses ranging from 0.040 to 0.060 inches.

While there have been shown and described what is at present considered to be the preferred embodiments of the invention, it is obvious to those skilled in the art that various changes and modifications can be made therein without departing from the invention as defined by the appended claims.

We claim:

1. A floor mountable door stop having a quarter-spherical backstop portion with a substantially vertical backstop face, an integral tongue mounting portion extending away from the bottom of the backstop face, and an integral anchor member extending downwardly from the bottom end of the quarter-spherical backstop portion, wherein the improvement comprises:

said door stop being constructed from sheet metal less than about 0.060 inches in thickness.

2. The door stop defined in claim 1 wherein said door stop is constructed from sheet metal having a thickness between about 0.040 inches and 0.060 inches.

3. A floor mountable door stop having a quarter-spherical backstop portion with a substantially vertical backstop face, an integral tongue mounting portion extending away from the bottom of the backstop face, and an integral anchor member extending downwardly from the bottom end of the quarter-spherical backstop portion wherein the improvement comprises:

said integral anchor member being substantially semi-circular.

4. A floor mountable door stop having a quarter-spherical backstop portion with a substantially vertical backstop face, an integral tongue mounting portion extending away from the bottom of the backstop face, and an integral anchor member extending downwardly from the bottom end of the quarter-spherical backstop portion, wherein the improvement comprises:

said door stop being constructed by stamping sheet metal.

* * * * *